US009027806B1

(12) United States Patent
Gioggia

(10) Patent No.: US 9,027,806 B1
(45) Date of Patent: May 12, 2015

(54) BEVERAGE AND PILL CARRIER DEVICE

(71) Applicant: Donald J. Gioggia, New Monmouth, NJ (US)

(72) Inventor: Donald J. Gioggia, New Monmouth, NJ (US)

( * ) Notice: Subject to any disclaimer, the term of this patent is extended or adjusted under 35 U.S.C. 154(b) by 0 days.

(21) Appl. No.: 13/935,888

(22) Filed: Jul. 5, 2013

(51) Int. Cl.
*A45F 3/20* (2006.01)
*A45F 5/02* (2006.01)

(52) U.S. Cl.
CPC ..... *A45F 5/021* (2013.01)

(58) Field of Classification Search
CPC ..... B65D 81/3886; F25D 3/08; A45F 2200/0583; A45F 3/00; A45F 3/16
USPC ..... 206/217; 224/148.4–148.7, 218, 251, 224/269, 666, 669, 587
See application file for complete search history.

(56) References Cited

U.S. PATENT DOCUMENTS

| | | | | |
|---|---|---|---|---|
| 4,802,602 | A | | 2/1989 | Evans et al. |
| 5,261,554 | A | * | 11/1993 | Forbes ..... 220/592.16 |
| D379,264 | S | | 5/1997 | Micieli |
| 5,996,781 | A | * | 12/1999 | Glaser et al. ..... 206/217 |
| 6,062,434 | A | * | 5/2000 | Melk ..... 222/175 |
| 6,145,715 | A | | 11/2000 | Slonim |
| 6,349,846 | B1 | | 2/2002 | Meza |
| 6,401,993 | B1 | | 6/2002 | Andrino |
| 6,457,616 | B2 | | 10/2002 | Gagne |
| 7,021,825 | B1 | | 4/2006 | Schultz |
| D632,930 | S | | 2/2011 | Chretien |
| 2007/0090136 | A1 | | 4/2007 | Stowell et al. |

* cited by examiner

*Primary Examiner* — Brian D Nash
*Assistant Examiner* — Corey Skurdal

(57) ABSTRACT

A beverage and pill carrier device attaches to a garment for hands free carrying of a beverage and discretely held medications. The device includes a container for holding a bottle. A hook is coupled to and extends from the container. The hook is attachable to a loop of a garment. A support wall is coupled to a perimeter wall of the container and extends through an interior space of the container. The support wall supports the bottle in spaced relationship to a base wall of the container. A pocket wall has a peripheral edge coupled to a perimeter edge of the base wall such that the pocket wall forms a pocket with the base wall. An opening extends into the pocket for insertion of pills into the pocket.

7 Claims, 3 Drawing Sheets

BEVERAGE AND PILL CARRIER DEVICE

BACKGROUND OF THE DISCLOSURE

Field of the Disclosure

The disclosure relates to carrying devices and more particularly pertains to a new carrying device for attaching to a belt loop for hands free carrying of a beverage and discretely held medications.

SUMMARY OF THE DISCLOSURE

An embodiment of the disclosure meets the needs presented above by generally comprising a container having a base wall and a perimeter wall coupled to and extending upwardly from a perimeter edge of the base wall. A top edge of the perimeter wall defines an opening into the container. The container is configured for holding a bottle holding a beverage. A hook is coupled to and extends from the container. The hook is attachable to a loop of a garment. A support wall is coupled to the perimeter wall and extends through an interior space of the container. The support wall supports the bottle in spaced relationship to the base wall. A pocket wall has a peripheral edge coupled to the perimeter edge of the base wall such that the pocket wall forms a pocket with the base wall. An opening extends into the pocket for insertion of pills into the pocket.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
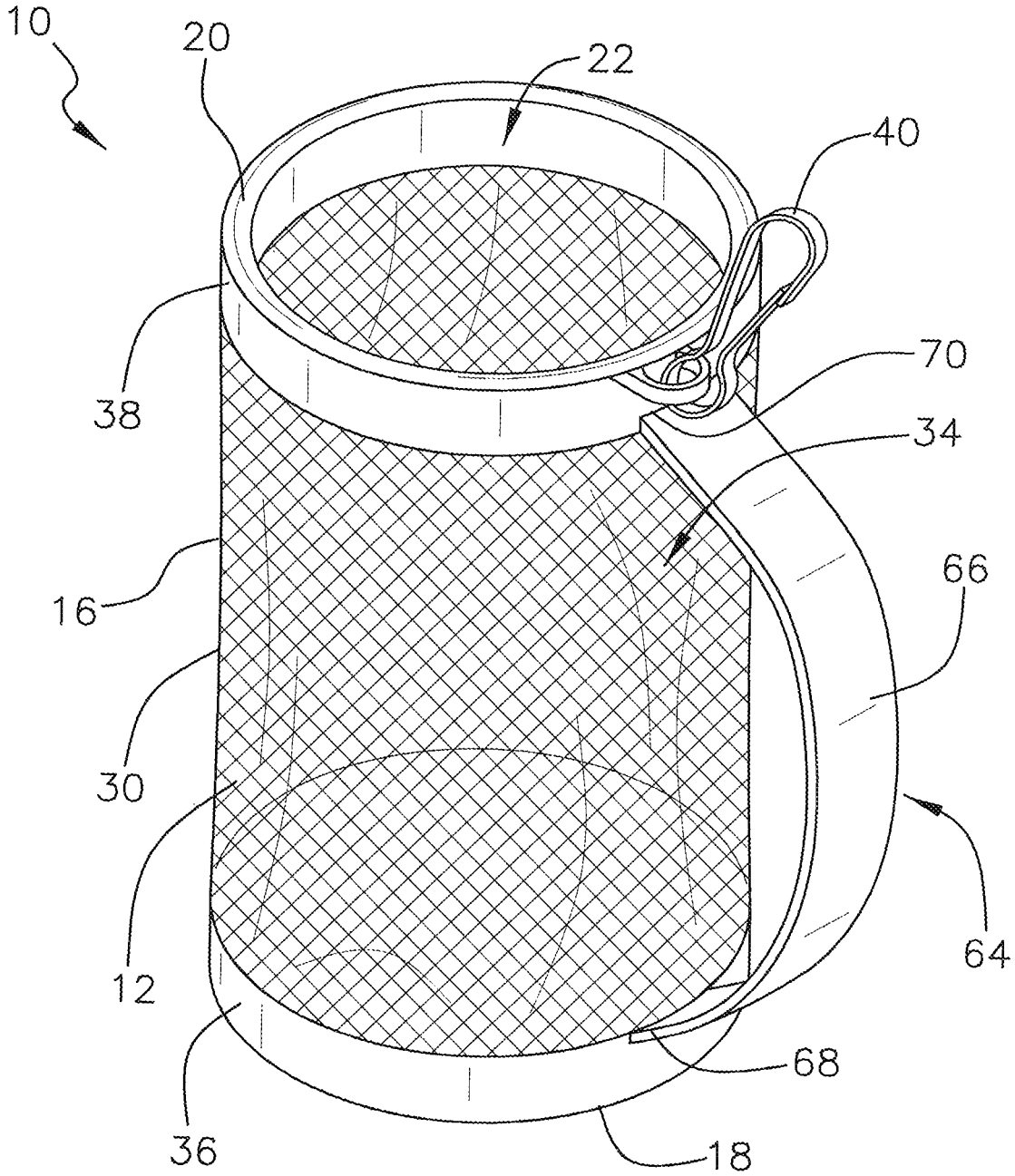
FIG. 1 is a top front side perspective view of a beverage and pill carrier device according to an embodiment of the disclosure.
Figure 2:
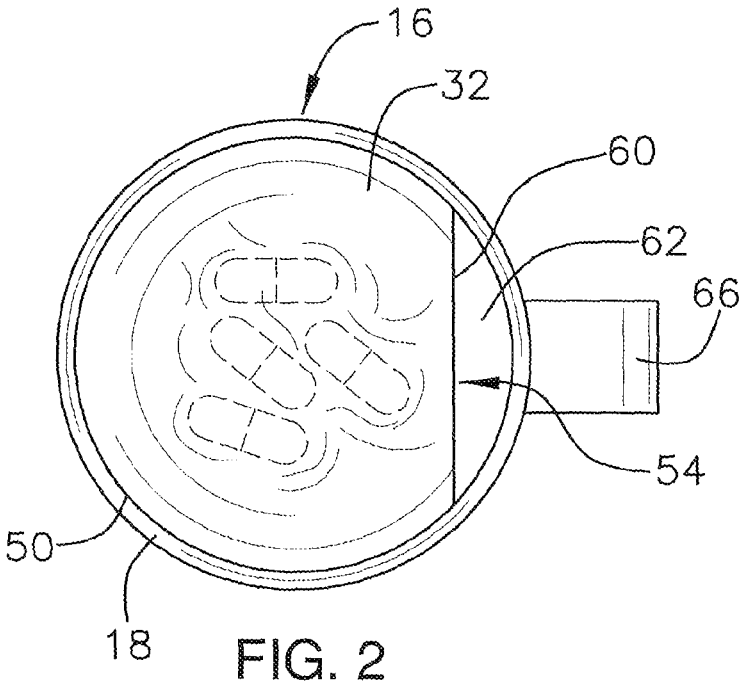
FIG. 2 is a bottom view of an embodiment of the disclosure.
Figure 3:
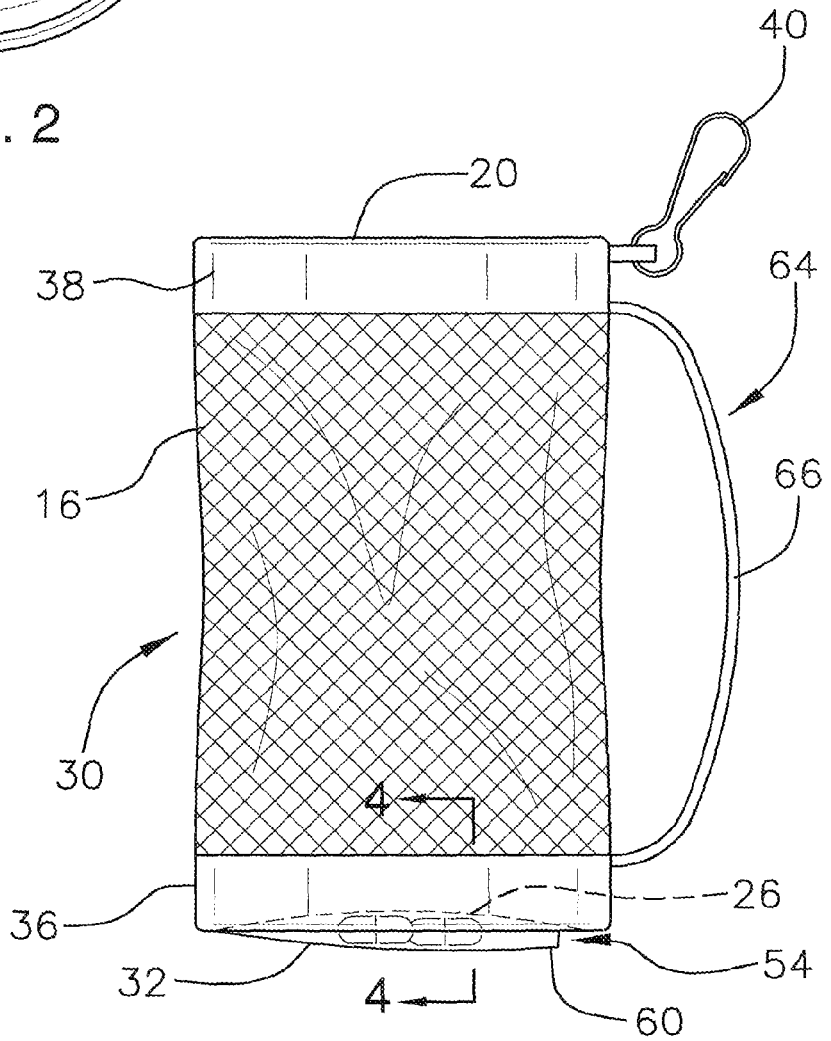
FIG. 3 is a side view of an embodiment of the disclosure.
Figure 4:
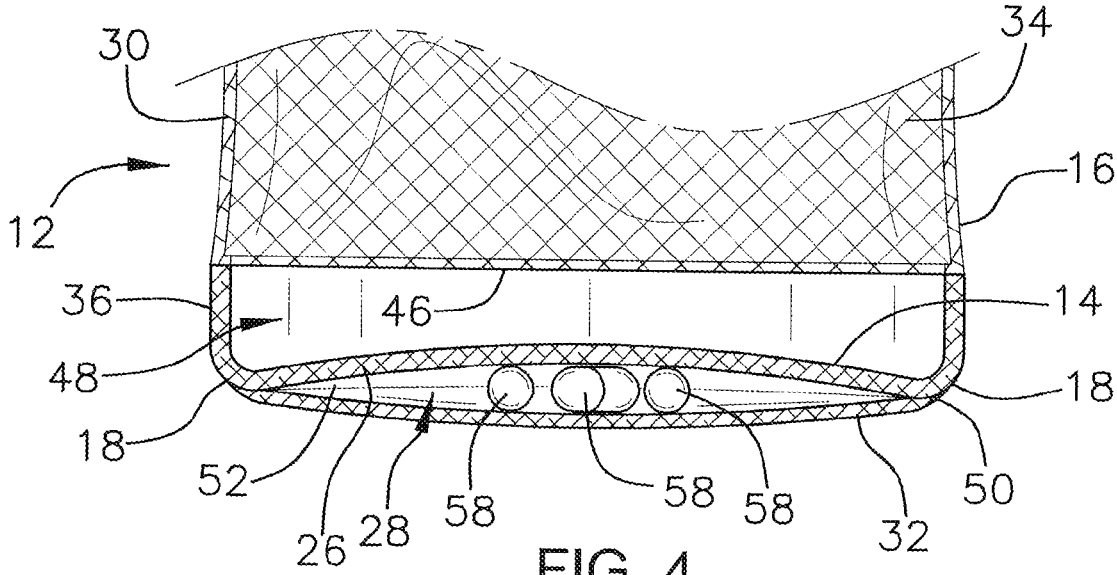
FIG. 4 is a cross-sectional view of an embodiment of the disclosure taken along line 4-4 of FIG. 3.
Figure 5:
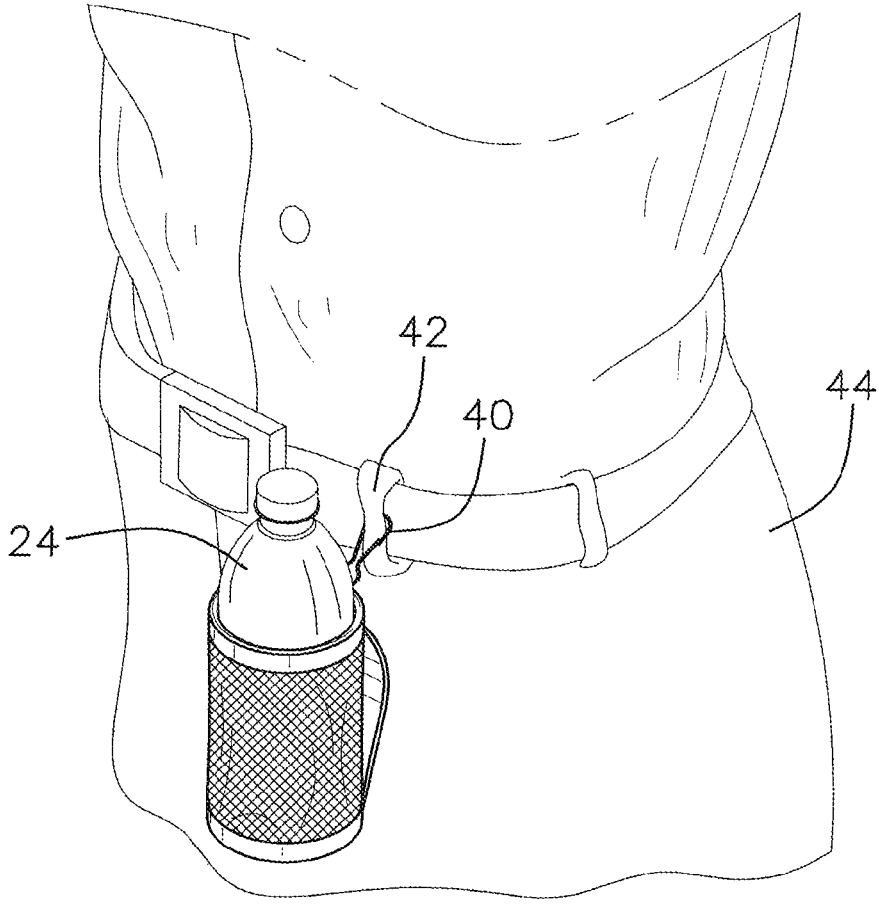
FIG. 5 is a top front side perspective view of an embodiment of the disclosure in use.

With reference now to the drawings, and in particular to FIGS. 1 through 5 thereof, a new carrying device embodying the principles and concepts of an embodiment of the disclosure and generally designated by the reference numeral 10 will be described.

As best illustrated in FIGS. 1 through 5, the beverage and pill carrier device 10 generally comprises a container 12 having a base wall 14 and a perimeter wall 16 coupled to and extending upwardly from a perimeter edge 18 of the base wall 14. A top edge 20 of the perimeter wall 16 defines an opening 22 into the container 12 configured to receive a bottle 24 holding a beverage such as water or the like. The container 12 is configured for holding the bottle 24 in a secure upright manner. The base wall 14 may have a concave outer face 26 wherein the base wall 14 forms a recess 28 extending upwardly from the perimeter edge 18 of the base wall 14. The perimeter wall 16 has a medial section 30 positioned between the perimeter edge 18 of the base wall 14 and the top edge 20 of the perimeter wall 16. The medial section 30 of the perimeter wall 16 may be constructed of a mesh material 34. The perimeter wall 16 may have a stiff lower section 36 extending between the medial section 30 and the perimeter edge 18 of the base wall 14. The perimeter wall 16 may further have a stiff upper section 38 extending between the medial section 30 and the top edge 20 of the perimeter wall 16. The medial section 30 may be flexible or collapsible along a longitudinal axis of the container 12 to facilitate compact storage of the device 10 when not in use.

A hook 40 is coupled to and extends from the container 12 proximate the top edge 20 of the perimeter wall 16. The hook 40 is configured for attaching to a loop 42 of a garment 44 such as a belt loop or the like. Thus, the container 12 is selectively coupled to the garment 44 permitting hands free transport of the bottle 26 as desired.

A support wall 46 is coupled to the perimeter wall 16. The support wall 46 extends through an interior space 48 of the container 12 such that the support wall 46 supports the bottle 26 in spaced relationship to the base wall 14. The support wall 46 may be transverse to the longitudinal axis of the container 12 and aligned with the lower section 36. The lower section 36 may be opaque and solid to obscure view of the positioning of the support wall 46. A pocket wall 32 has a peripheral edge 50 coupled to the perimeter edge 18 of the base wall 14 such that the pocket wall 32 forms a pocket 52 with the base wall 14. Thus, the pocket 52 extends into the recess 28. An opening 54 extends into the pocket 52 wherein the pocket 52 is configured for holding a plurality of pills 58. A closure 60 is coupled to the pocket 52. The closure 52 may comprise a zipper, hook and loop fastener, snaps, or the like. The closure 52 selectively closes the opening 54 into the pocket 52 wherein pills 58 positioned in the pocket 52 are prevented from falling out of the pocket 52 inadvertently. The opening 54 and the closure 60 may be aligned with and extend across a bottom face 62 of the container 12 wherein the pocket 52 is concealed from being seen when the container 12 is viewed from a lateral vantage relative to the container 12.

A handle 64 may be coupled to the container 12. The handle 64 may comprise a strap 66 having a bottom end 68 coupled to the perimeter wall 16 adjacent to the perimeter edge 18 of the base wall 14 and a top end 70 coupled to the perimeter wall 16 adjacent to the top edge 20 of the perimeter wall 16. The strap 66 may be oriented parallel to the longitudinal axis of the container 12.

In use, pills 58 are positioned in the pocket 52. The bottle 24 is positioned in the container 12 by insertion through the opening 22. The container 12 may then be carried using the handle 64 or attached to the garment 44 using the hook 40 for hands free carrying of the bottle 24 and pills 58.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A beverage and pill carrier device comprising:

a container having a base wall and a perimeter wall coupled to and extending upwardly from a perimeter edge of said base wall, a top edge of said perimeter wall defining an opening into said container, said container being configured for holding a bottle holding a beverage, said perimeter wall having a medial section positioned between said perimeter edge of said base wall and said top edge of said perimeter wall, said medial section of said perimeter wall being constructed of a mesh material, an interior of said container being visible through said mesh material, said base wall having a concave outer face wherein said base wall forms a recess extending upwardly from said perimeter edge of said base wall;

a hook coupled to and extending from said container, said hook being configured for attaching to a loop of a garment wherein said container is coupled to the garment;

a support wall coupled to said perimeter wall, said support wall extending through an interior space of said container wherein said support wall is configured for supporting the bottle in spaced relationship to the base wall;

a pocket wall having a peripheral edge coupled to said perimeter edge of said base wall such that said pocket wall forms a pocket with said base wall, said pocket being recessed into a base of said container;

an opening extending into said pocket wherein said pocket is configured for holding a plurality of pills; and a closure coupled to said pocket, said closure selectively closing said opening into said pocket wherein pills positioned in said pocket are prevented from falling out of said pocket, said opening and said closure being aligned with and extending across a bottom face of said container and said closure being opaque wherein said pocket is concealed from being seen when said container is viewed from a lateral vantage relative to said container.

2. The device of claim 1, further comprising said perimeter wall having a stiff lower section extending between said medial section and said perimeter edge of said base wall.

3. The device of claim 1, further comprising said perimeter wall having a stiff upper section extending between said medial section and said top edge of said perimeter wall.

4. The device of claim 1, further comprising a handle coupled to said container.

5. The device of claim 4, further comprising said handle comprising a strap having a bottom end coupled to said perimeter wall adjacent to said perimeter edge of said base wall and a top end coupled to said perimeter wall adjacent to said top edge of said perimeter wall.

6. The device of claim 5, further comprising said strap being oriented parallel to a longitudinal axis of said container.

7. A beverage and pill carrier device comprising:

a container having a base wall and a perimeter wall coupled to and extending upwardly from a perimeter edge of said base wall, a top edge of said perimeter wall defining an opening into said container, said container being configured for holding a bottle holding a beverage, said base wall having a concave outer face wherein said base wall forms a recess extending upwardly from said perimeter edge of said base wall, said perimeter wall having a medial section positioned between said perimeter edge of said base wall and said top edge of said perimeter wall, said medial section of said perimeter wall being constructed of a mesh material, an interior of said container being visible through said mesh material, said perimeter wall having a stiff lower section extending between said medial section and said perimeter edge of said base wall, said perimeter wall having a stiff upper section extending between said medial section and said top edge of said perimeter wall;

a hook coupled to and extending from said container, said hook being configured for attaching to a loop of a garment wherein said container is coupled to the garment;

a support wall coupled to said perimeter wall, said support wall extending through an interior space of said container wherein said support wall is configured for supporting the bottle in spaced relationship to the base wall;

a pocket wall having a peripheral edge coupled to said perimeter edge of said base wall such that said pocket wall forms a pocket with said base wall, said pocket extending into said recess;

an opening extending into said pocket wherein said pocket is configured for holding a plurality of pills;

a closure coupled to said pocket, said closure selectively closing said opening into said pocket wherein pills positioned in said pocket are prevented from falling out of said pocket, said opening and said closure being aligned with and extending across a bottom face of said container and said closure being opaque wherein said pocket is concealed from being seen when said container is viewed from a lateral vantage relative to said container; and a handle coupled to said container, said handle comprising a strap having a bottom end coupled to said perimeter wall adjacent to said perimeter edge of said base wall and a top end coupled to said perimeter wall adjacent to said top edge of said perimeter wall, said strap being oriented parallel to a longitudinal axis of said container.

* * * * *